United States Patent [19]

Cohune

[11] 4,154,478

[45] May 15, 1979

[54] PORTABLE HEADREST

[76] Inventor: William H. Cohune, 20-28, Lane 2 Yang Teh Ta Road, Section 2, Shehlin, Tapei, Taiwan

[21] Appl. No.: 876,199

[22] Filed: Feb. 9, 1978

[51] Int. Cl.[2] ..... A47C 1/10

[52] U.S. Cl. ..... 297/397; 297/407; 297/410

[58] Field of Search ..... 5/337, 338; 297/230, 297/231, 347, 406, 407, 410

[56] References Cited

U.S. PATENT DOCUMENTS

| | | | |
|---|---|---|---|
| 2,081,333 | 5/1937 | Hoover | 297/410 X |
| 2,306,334 | 12/1942 | Costas | 297/407 |
| 2,464,435 | 3/1949 | Conradt | 297/397 |
| 2,501,993 | 3/1950 | Conradt | 297/410 |
| 2,638,152 | 5/1953 | Pulsifer | 297/410 X |
| 2,708,475 | 5/1955 | Krewson | 297/410 |
| 2,822,033 | 2/1958 | Dixon | 297/231 |

*Primary Examiner*—James C. Mitchell
*Attorney, Agent, or Firm*—Christie, Parker & Hale

[57] ABSTRACT

A portable headrest for use in conjunction with the seats of public transportation vehicles. The headrest comprises a pair of padded supports which are secured to a chair back by means of a belt or a pair of hangers. The pair of supports are spaced apart to bracket the user's head and, in combination with the chair back, provide support for the user's head on three sides. The height of the headrest on the chair back is adjustable as is its position relative to the sides of the chair back. Each of the supports are also independently movable to adjust the spacing of the pads relative to each other. The unit is compact, portable and easily packed in a briefcase or suitcase.

13 Claims, 7 Drawing Figures

PORTABLE HEADREST

DESCRIPTION OF THE PRIOR ART

The present invention relates to headrests and, in particular, to a portable headrest utilizing a pair of spaced apart, padded supports suitable for temporary attachment to the back of a seat or to a backrest.

The present invention is designed to provide a traveler with the means for deriving an additional measure of comfort while traveling, that is, while seated in a chair on a means of public transportation, such as an airplane or train. Although the chair backs of the seats of most public transportation vehicles are adjustable, their adjustability is generally limited to being tilted, i.e., the seat can be pivoted backward or forward about a pivot point located at the base of the chair back. When the passenger desires to rest, the seat is tilted backwards. The only means for providing even minimal support for the passenger's head while he is trying to nap or otherwise rest is one or more pillows placed behind his head.

While pillows provide a minimum amount of support, they do not prevent the traveler's head from lolling back and forth or nodding forward in the event the passenger falls asleep. In some cases, the seating accomodation for passengers has been of the "wing chair" configuration providing, at the far side of each chair back, a panel extending perpendicularly from the chair back. When provided with this configuration, frequently the passenger will lean his head against the "wing" or position his head so that it rests in the "corner" defined by one of the "wings" and the chair back. Such a position is somewhat more restful, but is still uncomfortable in that the passenger has to distort his position in the chair in order to place his head in this position and can experience some discomfort of the neck and back.

SUMMARY OF THE PRESENT INVENTION

The present invention provides a solution to the foregoing problems by providing a lightweight, portable headrest unit for use on a universal basis in conjunction with the passenger seats in public transportation vehicles. The unit includes a pair of padded supports mounted by a strap or belt which is applied to the chair by encircling it around the chair back and cinching it tight. The pads are adjustably positioned on the belt to provide a means for locating each support at the desired lateral position along the chair back and at a spacing relative to each other so as to comfortably receive the user's head. When resting, his head is supported against the back of the chair and on both sides by the two bracketing head supports to prevent the head from turning or lolling.

Alternatively, the pads of the unit are suspended by hangers from the chair back. In this embodiment, the height of the unit is adjustable on the hangers by sliding each pad up and down along the hanger. Likewise, in the belt embodiment, the unit is completely adjustable as to height by cinching the belt to the seat at whatever height is desired. Normally, this is the height corresponding to the point on the chair back that the user's head will contact when the user is seated in the chair. The unit is likewise laterally positionable along the chair back to suit the peculiar needs of the user, if required.

In one embodiment, the pads are pivotally mounted on the buckles which support it on the belt so that their orientation can be varied from the vertical to an angle with respect to the vertical. In summary, the invention comprises a portable headrest, having a pair of spaced apart supports. Means is provided for mounting the supports on a chair back at a height corresponding to the height of the user when seated, the supporting means providing support for the user's head on each side.

The present invention enables the conversion of passenger seats in airplanes and the like, no matter what the configuration, to a comfortable headrest which provides support for the user's head on three sides. The unit is lightweight, padded to adequately and comfortably support the user's head and adjustable from the point of view of the height on the chair back, the spacing of the pads of the headrest relative to each other, and the positioning from side-to-side to enable the complete adaptation to the user's requirements. In its presently preferred embodiment, utilizing a pair of padded supports and a belt to which the supports are slidably attached, the unit is extremely compact and lightweight and completely portable. It can be attached and removed in seconds and occupies a small amount of space in a briefcase or suitcase and can be carried along by the traveler easily and conveniently.

DESCRIPTION OF A SPECIFIC EMBODIMENT

Figure 1:
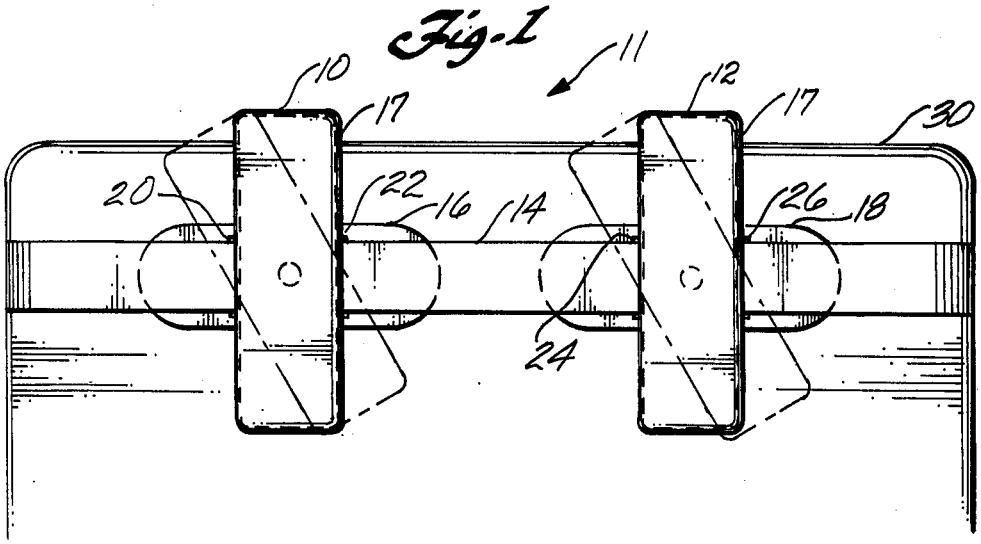
FIG. 1 is a front elevational view of the headrest according to the present invention as it is attached to a chair back.
Figure 2:
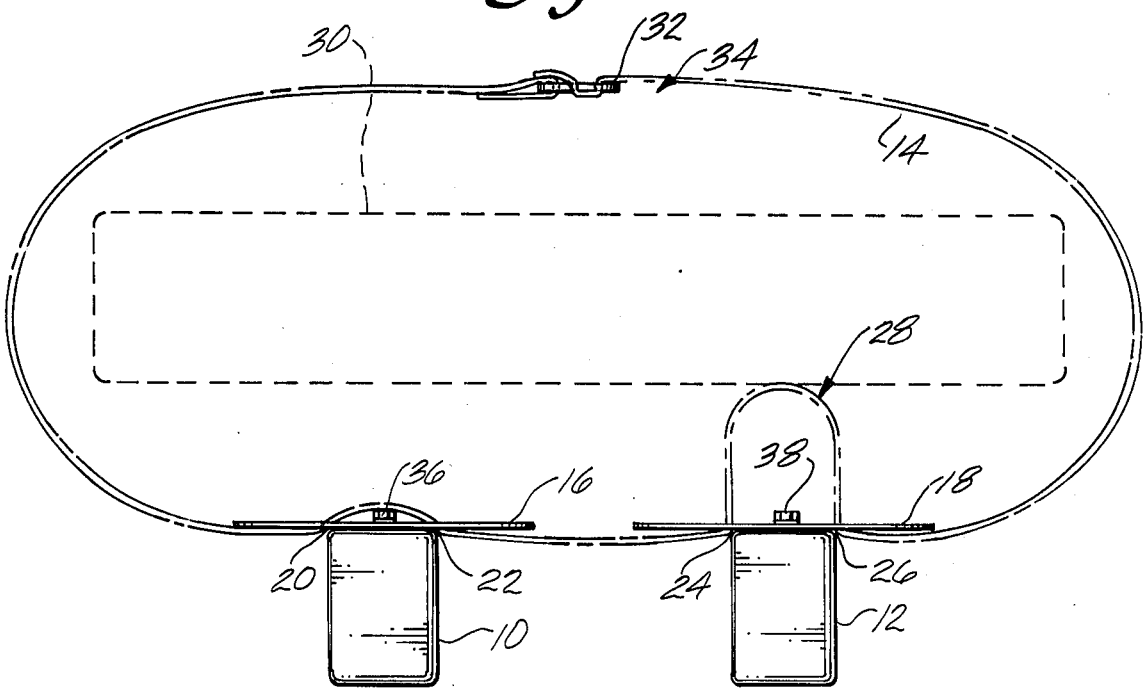
FIG. 2 is a plan view of the invention of FIG. 1.

As shown in FIGS. 1 and 2, the headrest 11 according to the present invention includes a first padded support 10, a second padded support 12 spaced from the first support. Each padded support is attached to a belt 14 by means of a buckle 16,18, respectively. In the presently preferred embodiment, each of the buckles is an oblong plate having a pair of slots 20,22 and 24,26, respectively. The spacing of slot 20 relative to slot 22 in buckle 16 is approximately equal to the width of padded support 10. The spacing of slots 24,26 in buckle 18 is similar. The slots extend transversely of the buckles and are of a length sufficient to allow the belt 14 to pass through in a flat mode without any transverse distortion. As is seen from FIG. 2, belt 14 enters slot 20 from front to back and passes behind buckle 16 and then passes through slot 22 from back to front. The belt path is similar with respect to support 12 and its supporting buckle 18. The belt enters from the front of slot 24 and passes behind the support 12 and then reemerges at the front of the unit through slot 26.

The portion or length of the belt 14 behind support 12 is exaggerated in FIG. 2 to show a large loop 28 to demonstrate the adjustability of the relative spacing of supports 10,12 on the belt. When it is desired to bring the supports closer together or to space them farther apart, the supports are slid along the belt or the belt is drawn through the buckles to draw the supports closer together or move them apart, depending on the change desired, and the relative position of the two supports is adjusted accordingly.

To secure the belt to a chair back 30, a cinching buckle 32 is attached to one end of the belt. Cinching buckle 32 is normally located at the rear of chair back 30. The headrest 11 according to the present invention is secured to the chair back by drawing the free end 34 of the belt through the cinching buckle until the belt is taut. The tension on the belt holds the padded supports 10,12 securely in position as shown in FIG. 1. Frictional forces between the belt and cinching buckle maintain the headrest in position on the chair back without slippage.

Figure 7:
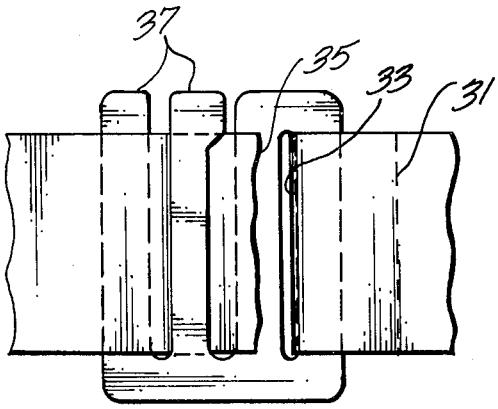
FIG. 7 is a detail view of the cinching buckle for securing the headrest to a chair back.

As seen from FIG. 7, the cinching buckle 32 has a comb-like configuration. One end 31 of the belt is drawn through the one closed loop 33 of the buckle 32 and then folded back and tacked or sewn to itself. The free end 35 of the belt is entwined through the teeth 37 of the comb configuration to provide the frictional engagement for securing the headrest in position.

Padded supports 10 and 12 are mounted on buckles 16 and 18 by means of pivots 36,38. The pivots permit the variation of the angular orientation of the pad supports to tilt one or both to the left or to the right. As shown in FIG. 1, in the phantom position, supports 10 and 12 are tilted to the left. Each of the supports in the preferred embodiment is a pad or block of a resilient material, such as foam rubber, encased in a suitable covering material, such as cotton cloth, corduroy, or the like. A stiffening member 17 is sewn inside the cover of each pad at the back thereof to stabilize the pads along the surface of contact with the chair back.

Figure 3:
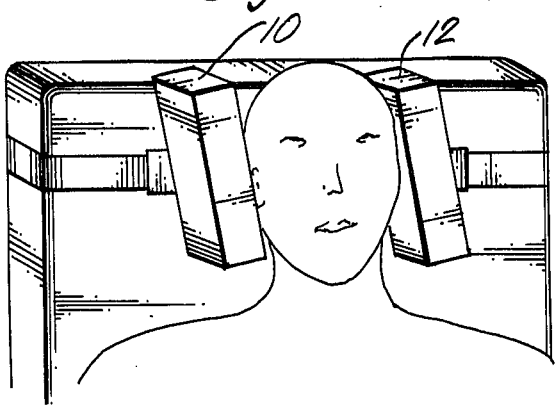
FIG. 3 is a perspective view of the invention in use.

The unit is shown in FIG. 3 as it is actually used. The headrest is attached to the seat and cinched tight with the spacing of supports 10 and 12 chosen by the user according to his comfort needs, normally a spacing slightly wider than his head. The position of the pad supports 10 and 12, relative to the sides of the chair back, is adjustable and can be located so as to position the user's head in the center of the chair back, to the right or to the left, again depending upon the user's comfort requirements. Likewise, by virtue of the pivotal mounting of the pad supports, the supports 10 and 12 can be tilted to one side or the other, depending upon his desires.

Figure 4:
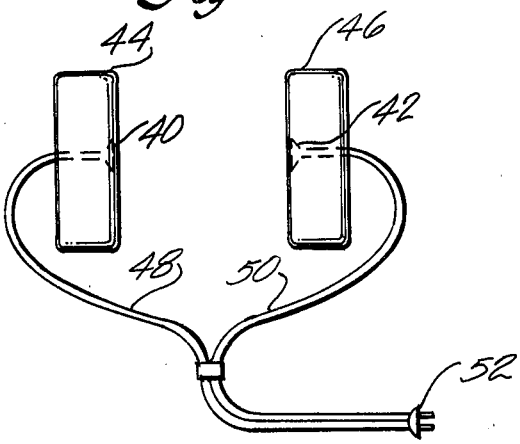
FIG. 4 is a front elevational view of an alternate embodiment of the headrest of the present invention in which the pads of the headrest incorporate speakers for communicating sound to the user.

The present invention also contemplates an adaptation of the headrest to include a pair of headphones or small speakers 40,42. As shown in FIG. 4, the headphones are implanted in a pair of padded supports 34,38 of a headrest according to the present invention and located so as to direct sound inwardly toward the space between the two supports. Preferably, the cone or outlet of each speaker is positioned adjacent to the interior side of its respective padded support close to the user's head. Speakers 40,42 are specifically located within the pad supports to correspond to the user's ears. A pair of tubes or wires 48,50 connect speakers 40,42 to a plug 52 which can be of the conventional hollow tube type. Plug 52 is adapted to be inserted into a sound outlet such as the sound conduit outlet provided in a seat used in airline accomodations. Alternatively, headphones 48,50 are actual electrical speakers and tubes 48,50 are hard wires connectable to a common sound system for the passenger vehicle.

Figure 5:
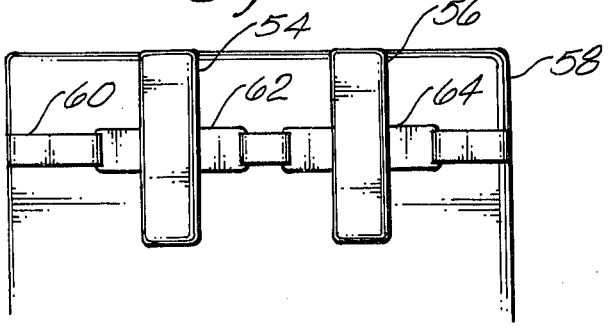
FIG. 5 is a front elevational view of an alternate embodiment of the invention in position on a chair back.

An alternate embodiment of the portable headrest of the present invention is shown in FIG. 5. As shown therein, the headrest comprises a pair of padded supports 54,56 supported on a chair back 58 by means of a belt 60 which passes around and is cinched at the back of the chair. A pair of sleeves 62,64 provide the means whereby the pads 54,56 are mounted on the belt. In the embodiment shown in FIG. 5, the sleeves 62, 64 are flat, elongated tubes through which the belt passes. The padded supports 54 and 56 are pivotally mounted on the front half of each of the respective sleeves to provide the pivotal adjustability of the pad supports. As is the case with the preferred embodiment, the position of the headrest is adjustable from side-to-side on the chair back by sliding the pads along the belt toward one side or the other of the chair back, and likewise the height of the unit is adjustable on the chair back by loosening the belt and raising and lowering the unit along the chair back to the height desired.

Figure 6:
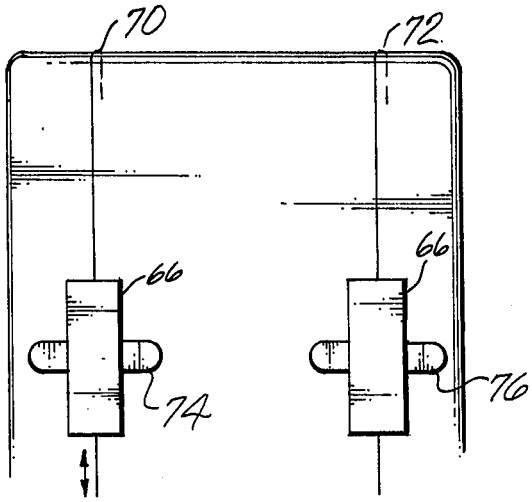
FIG. 6 is an additional embodiment illustrating an alternate form of suspension for the headrest.

An alternate embodiment to the invention is shown in FIG. 6 which is used in the instances where the construction of the rear of the chair back is such as to limit the height adjustability of the unit. For example, in the case of seats used in aircraft, the rear of the chair back is typically hollowed out to receive a fold-down table for use by the passenger immediately behind the headrest user's chair. At certain heights, the belt of the headrest according to the present invention would be looped around the fold-down table and would prevent it from being easily raised and lowered. In such an event, the unit of FIG. 6 is used. As shown therein, a pair of padded supports 66,68 are provided, but in this case, the headrest is secured to the chair back by means of a pair of hangers 70,72 which extend from the supports up to and back over the chair back so that the head supports are, in effect, hung from the top of the chair back. Each of the supports is longitudinally movable up and down along the hanger 70 and 72 to provide a complete height adjustment.

The headrest unit shown in FIG. 6 is also particularly suited for use with passengers of small stature and children. To provide support and stabilization for the padded supports, a pair of flat plates 74,76 are provided, extending transversely of the longitudinal axis of the padded supports. When the user exerts pressure on either of the pads by tending to turn his head to the right or to the left, the plates 74 and 76 will prevent the supports from turning or pivoting and continue to provide the support function.

A particular feature of the unit is its portability. As can be seen, the unit comprises, basically, a belt and two padded supports which are attached to the belt and extend transversely thereof. A simple cinch or buckle is provided at the rear of the belt to allow it to be tightened and held securely in position on the chair back. The unit is easily attached and removed and, because the belt is flexible and the padded supports are relatively small, can be folded into a small compact unit which easily fits in a piece of luggage, such as a briefcase or suitcase. This permits the user to carry the unit with him wherever he goes while traveling.

In a preferred embodiment, the unit also incorporates the headphones as shown in FIG. 4 to make the unit serve the dual function of a headrest and earphones for use with the sound system with which passenger vehicles are frequently equipped. In use, the headrest of the present invention, in combination with the chair back, provides a three-sided enclosure for the user's head. Any tendency of the head to turn when the user relaxes or naps is prevented by the side support of the pads. The traveler can thus rest without concern that he will turn or slide to either side as he relaxes and is in fact able to lean against and support the side of his face by means of either of the two pads, increasing significantly the possibility of deriving real relaxation even while traveling in a seated position.

Although described particularly with reference to the seats in public passenger vehicles, the headrest of the present invention is likewise suited for use in many models of private automobiles and with easy chairs and the like in the home.

What is claimed is:

1. A portable headrest comprising:

a pair of spaced apart padded supports;

mounting means for each of the supports for individually slidably adjusting the lateral spacing of the supports relative to each other;

pivot means mounting each of the padded supports on the mounting means for altering the angular orientation of each of the supports about a horizontal axis on a chair back; and means for removably mounting the padded support mounting means on the chairback at a height corresponding to the height of the user's head when seated to provide support for the user's head on each side thereof.

2. A headrest according to claim 1, wherein the mounting means is a belt.

3. A headrest according to claim 2, including means for slidably mounting the supports on the belt.

4. A headrest according to claim 3, wherein the slidable support means are a pair of buckles operatively engaged with the pair of spaced apart supports.

5. A headrest according to claim 3, wherein the slidable supporting means are a pair of sleeves slidably receiving the belt, the supports being operatively engaged with the sleeves.

6. A headrest according to claim 4, wherein the supports are pivotally mounted on the buckles.

7. A headrest according to claim 1, wherein the means for removably mounting the supports is a belt and a cinching buckle for loosening and tightening the belt, thereby permitting the unit to be raised and lowered along the height of the chair.

8. A headrest according to claim 1, wherein the means for removably mounting the supports is a pair of hangers extending over the chair back, each hanger being associated with a respective one of the supports.

9. A headrest according to claim 8, wherein the supports are slidably mounted on the hangers.

10. A headrest according to claim 1 including a pair of sound outlets incorporated into the pair of padded supports and means for connecting the sound outlets to a source of sound.

11. A headrest according to claim 10 wherein the sound outlets are a pair of sound-powered speakers and the connecting means are a pair of sound conduits.

12. A headrest according to claim 10 wherein the sound outlets are a pair of electrical speakers and the connecting means are electrical connections.

13. A portable headrest comprising:

a pair of padded supports;

buckle means for mounting each padded support on a chairback;

pivot means interconnecting each padded support and buckle means for rotatably adjusting the supports on the buckle means;

belt means slidably engaged with the buckle means for adjusting the relative spacing of the supports along the belt; and cinching means operatively engaged with the belt for removably securing the headrest at adjustable heights corresponding to the height of the user's head on the chairback.

* * * * *